United States Patent [19]

Owen

[11] 3,938,656

[45] Feb. 17, 1976

[54] CONTAINER CARRIER AND METHOD OF MAKING SAME

[75] Inventor: Ronald Charles Owen, Harwood Heights, Ill.

[73] Assignee: Illinois Tool Works Inc., Chicago, Ill.

[22] Filed: Dec. 2, 1974

[21] Appl. No.: 528,851

[52] U.S. Cl. ..... 206/150; 206/427; 229/28 R; 24/16 PB

[51] Int. Cl.[2] ..... B65D 71/02; B65D 63/10; B65D 85/62; B26D 3/00

[58] Field of Search ..... 206/150, 3, 145, 427, 805; 83/54; 24/16 PB; 229/28 R

[56] References Cited

UNITED STATES PATENTS

| | | | |
|---|---|---|---|
| 1,999,909 | 4/1935 | Lupton | 229/28 R |
| 2,154,085 | 4/1939 | Bergstein | 229/28 R |
| 2,982,434 | 5/1961 | Hidding | 215/100 A |
| 3,785,484 | 1/1974 | Cunningham | 206/427 |

FOREIGN PATENTS OR APPLICATIONS

| | | | |
|---|---|---|---|
| 1,132,912 | 11/1956 | France | 206/805 |

*Primary Examiner*—William T. Dixson, Jr.
*Attorney, Agent, or Firm*—Olson, Trexler, Wolters, Bushnell & Fosse, Ltd.

[57] ABSTRACT

There is disclosed a carrier for a plurality of articles or containers such as boxes, cans, bottles and the like, and a method of making the same, comprising providing a flattened tube of plastic material which is partially slit for defining successive sections which may be unfolded to form interconnected annular rings for insertion of the articles and which tube is provided with integral webs extending between the rings for presenting handle or gripping means for the carrier.

9 Claims, 10 Drawing Figures

CONTAINER CARRIER AND METHOD OF MAKING SAME

BACKGROUND OF THE INVENTION

The present invention relates to a novel carrier for a plurality of articles or containers such as boxes, bottles, cans and the like, and a novel method of making the carrier.

In my application Ser. No. 360,081, filed May 14, 1973, there is disclosed a novel carrier and method wherein a thin-walled tube is formed from a sheet or extruded from plastic or other suitable stock material, which tube is then flattened and alternately slit partially therethrough from opposite edges of the flattened structure whereby to provide a plurality of interconnected rings which may be unfolded for receiving the articles or containers to be carried. It is an important object of the present invention to provide a novel carrier and method of making same which incorporates features disclosed in the aforesaid prior application and which also includes handle means for facilitating gripping of the carrier, which handle means is formed integral with the tube structure in a manner which does not interfere with slitting and unfolding of the tube structure.

A further specific object of the present invention is to provide a novel multiple article carrier and method of making same, as described above, wherein a variety of numbers of articles or containers may be accommodated and handle means are provided for facilitating balanced handling of a package including the novel carrier, regardless of its size or configuration.

Other objects and advantages of the present invention will become apparent from the following description and the accompanying drawings.

DETAILED DESCRIPTION OF THE DISCLOSED EMBODIMENTS

Figure 4:
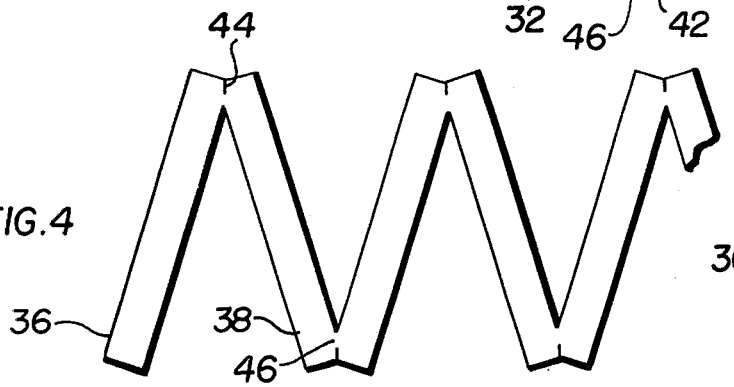
FIG. 4 is a side elevational view showing a further step in the method of the present invention wherein the flattened and slit blank of FIG. 2 is unfolded so as to deploy successive ring portions of the tube structure toward article receiving positions.
Figure 5:
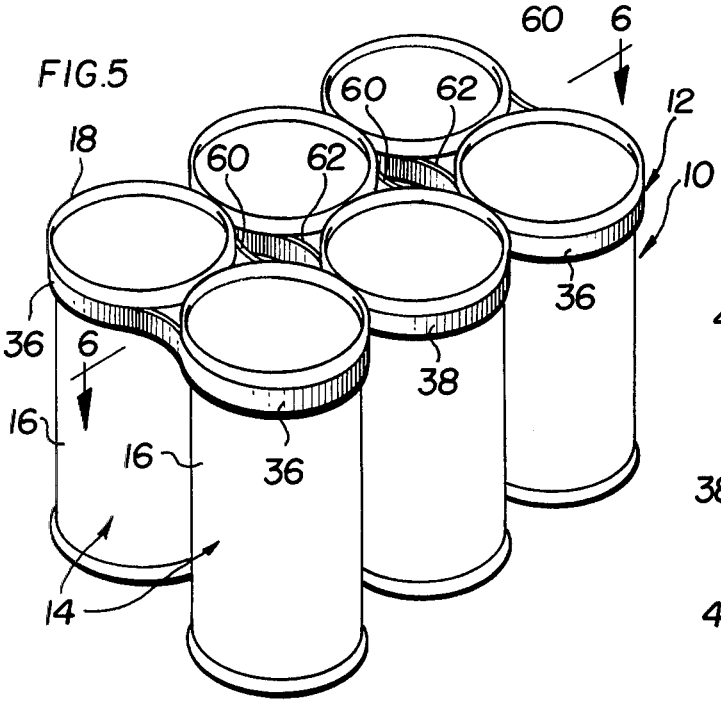
FIG. 5 is a perspective view showing a package incorporating a carrier of the present invention assembled with a plurality of articles such as cans.

Referring now more specifically to the drawings wherein like parts are designated by the same numerals throughout the various figures, a package 10 is shown in FIGS. 4 and 5 which includes a carrier 12 made in accordance with the present invention and a plurality of articles 14. In the embodiment shown, the articles are in the form of conventional cans having cylindrical bodies 16 and end seams or rims 18 of known construction which project not only axially but also radially with respect to the body wall to provide a shoulder or flange. The carrier 12 tightly encircles and grips the articles or can bodies in a position so that upper edges of the carrier preferably engage the under surface of the end seam or flanges 18.

Figure 1:
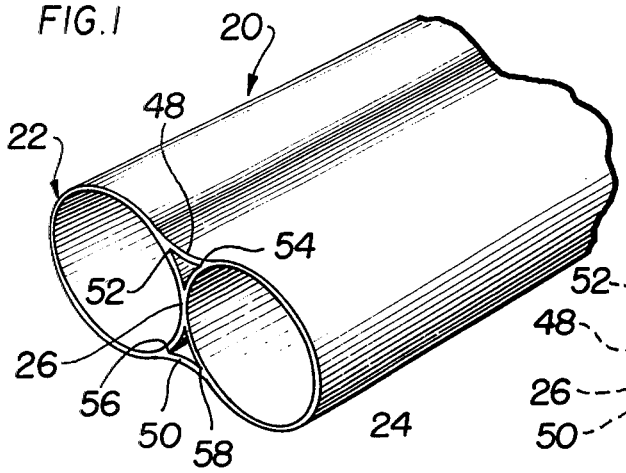
FIG. 1 is a perspective view showing a tube structure formed in accordance with features of the present invention and from which carriers of the present invention may be produced.
Figure 2:
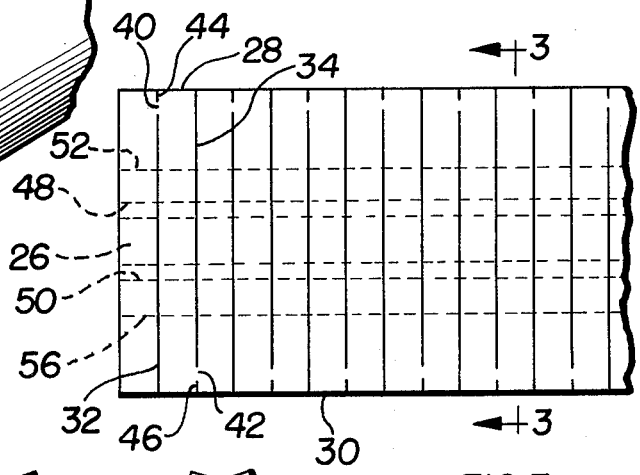
FIG. 2 is a plan view showing one step in the method of the present invention wherein the tube structure of FIG. 1 is manipulated into a substantially flattened condition, and alternately slit a part of the way therethrough alternately from opposite edges.
Figure 3:
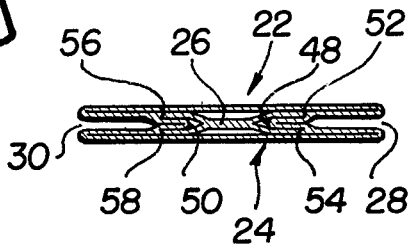
FIG. 3 is a sectional view taken along line 3—3 in FIG. 2.

The carrier 12 incorporates structural features and is produced substantially in accordance with the method disclosed in my aforementioned application Ser. No. 360,081 filed May 14, 1973, the disclosure of which is incorporated herein by reference. Therefore common portions of the disclosure need only be briefly set forth herein. More specifically, the carrier 12 is formed from a tube structure 20 of stock material which is preferably a tough, resilient, plastic material such as low density polyethylene. The tube structure 20 may be formed from plastic sheet material, but is preferably extruded in the configuration shown in FIG. 1 so as to include a pair of juxtaposed tubes 22 and 24 having areas of closest proximity preferably integrally joined at junction 26. In order to form the carrier 12 from the tube structure 20, the tube structure is first flattened as shown in FIGS. 2 and 3 so that the tubes 22 and 23 are flattened together with junction 26 located substantially midway between opposite side margins or edges 28 and 30 of the flattened structure. As shown in FIG. 3, the opposite edges 28 and 30 are actually double edges provided by the flattened tubes 22 and 23.

The flattened tube structure is then formed with slits 32 and 34 at axially spaced intervals, which slits extend alternately from the edge 30 but short of the edge 28 and from the edge 28 toward and short of the edge 30. The arrangement is such that the slits define successive pairs of juxtaposed attached ring sections 36 and 38 in the tubes 22 and 23. These ring sections have an axial extent substantially greater, usually several times greater than their wall thickness and present opposing edges or margins which are integrally connected or hinged together by unsevered portions 40 and 42 adjacent the edges 28 and 30. In the embodiments shown, the hinge portions 40 and 42 have short slits 44 and 46 formed therein at the edges to facilitate subsequent manipulation of a carrier.

In order to form a carrier from the slitted blank of FIG. 2, successive pairs of ring sections 36 and 38 of tubes 22 and 23 are unfolded through the position shown in FIG. 4 to a horizontal container receiving position, as shown in FIG. 5. The containers or cans are then slipped into the pockets provided by the ring sections 36 and 38. The internal diameter of each ring section 36 and 38 is preferably slightly less than the diameter of the can body 16 so that the plastic material must be slightly stretched to receive the can body. However, the difference is such that the stretching of the plastic material will not exceed its elastic limit. In the arrangement shown, the hinge section alternately extends between lower and upper edges or margins of the ring sections.

In accordance with the present invention, the carrier 12 is provided with handle means for enabling a user to grip and carry the package more readily. Furthermore, the handle means is provided in a manner so that it is properly positioned for enabling a user to grip the carrier at a desired location and at the same time the handle means does not interfere with the formation of the tube structure, the subsequent flattening and slitting of the tube structure, and unfolding of the rings as described above.

Figure 6:
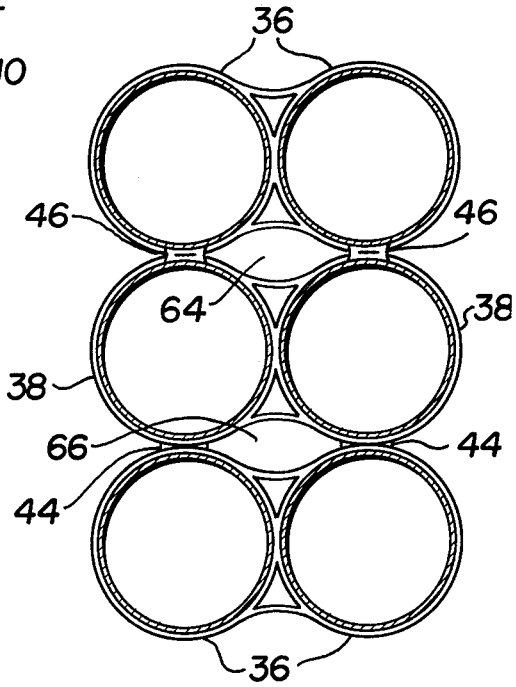
FIG. 6 is a sectional view taken along line 6—6 in FIG. 5.
Figure 7:
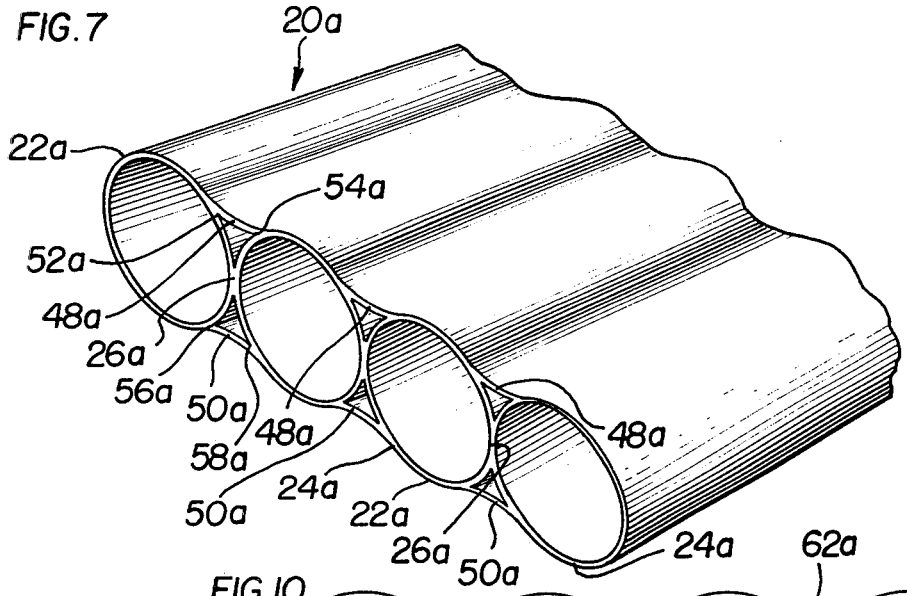
FIG. 7 is a perspective view similar to FIG. 1 but showing a modified form of the present invention.
Figure 8:
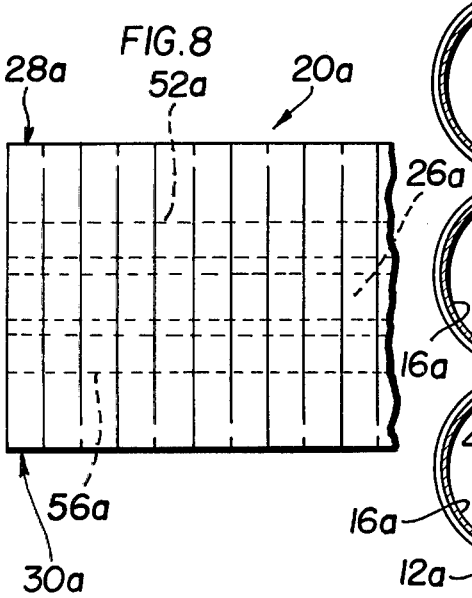
FIG. 8 is a plan view similar to FIG. 2 but showing the tube structure of FIG. 7 in a flattened and slit condition.

The tube structure 20 is formed with webs 48 and 50 respectively between junctions 52–54 and 56–58 with the tubes 22 and 24. As shown in FIG. 1, the junctions of the webs with the tubes are spaced circumferentially from the integral junction 26 between the tubes themselves. While the spacing of the junctions 52–58 from the junction 26 may be varied considerably, it is preferably on the order of about 45°. It is noted that the webs 48 and 50 are respectively severed by each of the slits 32 and 34 so that they are divided into web elements 60 and 62 extending between each pair of adjacent article receiving pocket ring sections as shown in FIGS. 5 and 6. Each pair of web or strap elements 60 and 62 at opposite sides of the junction 26 between their respective ring sections provides handle means which may be easily grasped between the thumb and fingers of a person handling the package. Preferably the strap elements 60 and 62 have an oppositely disposed concave configuration which coupled with the location of their junctions with the ring sections provides adequate openings 64 and 66 for receiving the fingers of a person carrying the package. It will be noted that the person carrying the package may grip either the centermost pair of the handle elements 60 and 62 so that the weight of the package will be balanced, or if desired he may grip either endmost pair of the handle elements.

In FIGS. 5 and 6 it is seen that the carrier is constructed for providing a "six-pack" package. This is accomplished by severing from the continuous blank or tube structure of FIG. 2, a unit comprising three pairs of the adjacent ring sections 36 and 38. It is to be understood, however, that the strip may be severed so as to provide a carrier having a different number of ring sections such, for example, as four or eight.

In FIGS. 7–10, there is shown a modified form of the present invention which is especially suitable for providing carriers having a larger number of ring or pocket sections for accommodating a larger number of articles. The structure of this embodiment is substantially the same as that described above as indicated by the application of identical reference numerals with the suffix a added to corresponding elements. This embodiment differs primarily in that the tube structure 20a is formed with more than two side-by-side tubes **22*a* and 24*a*. In the embodiment shown, the tube structure 20*a* is formed with four such adjacently disposed tubes having integral junctions 26*a*, but it is to be understood that the structure might be formed either with three such adjacently disposed and integrally joined tubes or more than four tubes. In any event, the tube structure 20*a* is preferably initially extruded and then flattened and slit alternately from opposite side edges in the same manner as the tube structure described above and as indicated in FIG. 8.** The slit tube structure blank is then unfolded in the manner described above so as to deploy the ring sections or pocket members for receiving the articles.

Figure 10:
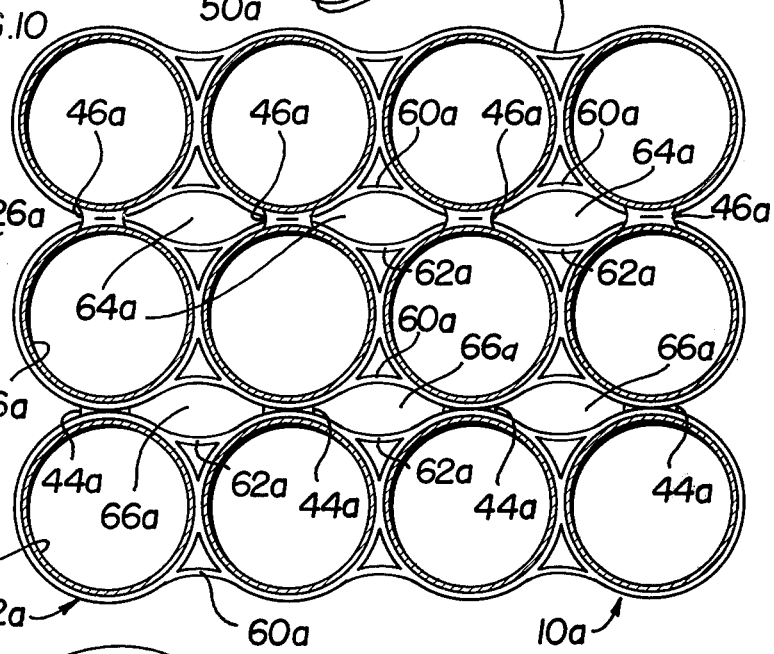
FIG. 10 is a sectional view taken along line 10—10 in FIG. 9.
Figure 9:
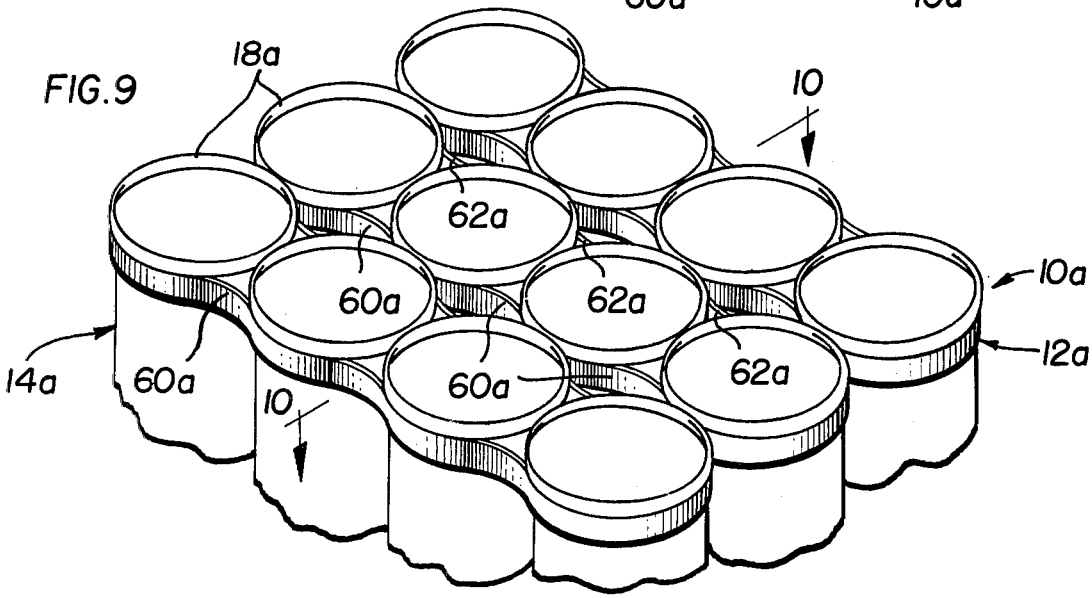
FIG. 9 is a perspective view showing a package including a carrier formed from the blank of FIG. 8 assembled with a plurality of articles such as cans.

In the embodiment shown in FIGS. 9 and 10, three groups of four ring sections are severed from the remainder of the tube structure so as to provide a "twelve-pack." Again, it is noted that either a smaller or larger number of the groups of four side-by-side ring sections may be severed from the blank so as to provide packages of desired different sizes.

While preferred embodiments of the present invention have been shown and described herein, it is obvious that many changes may be made without departing from the spirit and scope of the appended claims.

The invention is claimed as follows:

1. A carrier for a plurality of articles such as containers and the like comprising a set including a pair of adjacently disposed annular sections of flexible material each having an upstanding wall having a height greater than its thickness and upper and lower margins, said annular sections having an area of closest proximity to each other, and elements extending between said annular sections at opposite sides of said area and providing handle means for facilitating handling of the carrier.

2. A carrier as defined in claim 1 which includes a plurality of said sets of said annular sections, and flexible junction elements joining adjacent annular sections of adjacent sets to each other along segments of their adjacent margins.

3. A carrier as defined in claim 2 which includes at least three of said sets of annular sections, certain of said junction elements joining upper margins of sections of an intermediate set to sections of a first adjacent set and other said junction elements joining lower margins of sections of said intermediate set to sections of another adjacent set.

4. A carrier as defined in claim 1 wherein said set of annular sections includes at least three annular sections.

5. A carrier as defined in claim 2 wherein each of said sets of said annular sections consists of two annular sections.

6. A carrier as defined in claim 2, wherein each of said sets of annular sections comprises two pairs of adjacently disposed annular sections.

7. A method of forming a carrier having a plurality of thin-walled upstanding adjacent annular sections presenting free upper and lower margins with junction elements joining adjacent segments of margins of adjacent annular sections and strap-like elements between adjacent annular sections comprising providing a tube structure of thin flexible material including a pair of side-by-side tubes having a longitudinal area of closest proximity to each other and web elements extending between said tubes at opposite sides of said area, substantially flattening said tubes together with said area and said web elements therebetween and thereby providing a substantially flattened tube structure presenting opposite margins, and alternately transversely slitting the tube structure from said opposite margins partially across the tube structure and along generally parallel lines spaced axially of the tube structure.

8. A package comprising a plurality of juxtaposed articles such as containers and a carrier retaining said articles in the package, said carrier comprising a set including at least two adjacently disposed annular thin-walled sections of flexible, stretchable material each having an upstanding wall having a height greater than its thickness and upper and lower free margins, said annular sections having an area of closest proximity to each other, and elements extending between said annular sections at opposite sides of said area and providing handle means for facilitating handling of the carrier.

9. A package as defined in claim 8, wherein said carrier includes a plurality of said sets of annular sections, and flexible junction elements joining adjacent annular sections of adjacent sets to each other along segments of their adjacent margins.

* * * * *